United States Patent [19]

Yamanaka et al.

[11] 4,290,038

[45] Sep. 15, 1981

[54] SCANNING-AREA ROTATION DEVICE FOR AN IMAGE PICKUP TUBE

[75] Inventors: Junichi Yamanaka, Sagamihara; Noboru Nakamura, Yokohama; Hirokazu Fujiki, Asakusabashi; Yoshimori Miyaji, Tokyo, all of Japan

[73] Assignee: Tokyo Shibaura Denki Kabushiki Kaisha, Kawasaki, Japan

[21] Appl. No.: 66,764

[22] Filed: Aug. 14, 1979

[30] Foreign Application Priority Data

Aug. 18, 1978 [JP] Japan ..... 54-113140[U]

[51] Int. Cl.[3] ..... H01J 31/26

[52] U.S. Cl. ..... 335/214; 335/301; 315/10

[58] Field of Search ..... 335/214, 202, 301; 174/35; 336/84; 315/10; 358/51

[56] References Cited

U.S. PATENT DOCUMENTS

| | | | |
|---|---|---|---|
| 2,217,409 | 10/1940 | Hepp | 335/214 |
| 4,145,678 | 3/1979 | Takikawa | 335/214 |
| 4,221,992 | 9/1980 | Ueda et al. | 315/10 |

FOREIGN PATENT DOCUMENTS

| | | | |
|---|---|---|---|
| 1190411 | 5/1970 | United Kingdom | 335/214 |

*Primary Examiner*—Harold Broome

*Attorney, Agent, or Firm*—Cushman, Darby & Cushman

[57] ABSTRACT

A scanning-area rotation device for an image pickup tube has a coil (10) for rotating a scanning-area by an electron beam on the target surface of an image pickup tube (14), a shield ring (46) for electrostatically shielding the coil (10) from the target of the image pickup tube (14), and a shield cover (44) for magnetically shielding the coil (10). The shield ring (46) electrostatically shields the target and signal circuit connecting to the target from the coil (10), but does not shield a magnetic flux from the coil (10) to the target. The shield cover (44) shields a magnetic flux developed by the coil (10) and extending to the exterior of the cover (44).

7 Claims, 7 Drawing Figures

SCANNING-AREA ROTATION DEVICE FOR AN IMAGE PICKUP TUBE

BACKGROUND OF THE INVENTION

The present invention relates to a device for rotating a raster or a scanning-area on a target face of an image pickup tube by an electrical means.

By convention, a TV camera using a magnetic focusing and magnetic deflecting type tube such as a Plumbicon (trade name) which is an image pickup tube utilizing a photoconductive effect by using PbO for the target, employs a mechanical means for making a fine adjustment of the inclination of the raster on the target face. A deflection yoke including vertical and horizontal deflecting/focusing coils disposed surrounding the pickup tube is mechanically rotated about the axis of the image pickup tube. In a three-tube type color camera, unless red, blue and green rasters are completely registered to each other, color edging occurs in a picture. To prevent color edging from occurring, it is necessary to perform a precise and fine adjustment of the raster inclination of at least two of the three camera tubes. Such an adjustment and adjustments of deflecting/focusing conditions are called a registration. If an electrical means, in place of the conventional mechanical means, is used, the fine adjustment of the registration may readily and automatically be performed.

As is known, in the prior art the raster may be rotated by changing the current of the focusing coil of the image pickup tube or by changing the voltage of the third grid. However, when the raster is rotated by such current or voltage change, off-focusing of electron beams takes place as the raster is progressively rotated. Therefore, when the inclination of the raster is adjusted to an optimum position, there is a strong possibility that the resolution of a picture picked up by the image pickup tube is deteriorated.

To solve the problem, there is provided an electrical rotation system to rotate the electron beam focused onto the target by applying a static magnetic field around the target. Using the electrical rotation system, provided the registration never results in the off-focusing of the electron beam.

In FIG. 1, there is shown a schematic representation in cross sectional form of an image pickup tube to perform the electrical rotation. As shown, a rotation coil 10 is coaxially located in front of and along the periphery of the target face 12 of a pickup tube 14 around which a deflection coil 16 and a focus coil 18 are fitted. The rotation coil 10 applies a static magnetic field to rotate the scanning area on to the target face 12.

FIG. 2 shows a schematic representation illustrating a case where the electrical rotation is applied to the three-tube type color television camera. In the figure, reference numeral 20 designates a lens system for focusing an optical image of an object (not shown) onto the target; 22 a decomposing optical system (a dichroic prism, for example) for decomposing the optical image into images of the three primary colors (red, green and blue); 14R, 14G and 14B image pickup tubes for producing red, green and blue image signals; 10R, 10G and 10B rotation coils.

In the color television camera using the dichroic prism 22, the target faces of the image pickup tubes 14R, 14G and 14B are disposed closely to each other. With this arrangement, when a DC current flows in the rotation coils 10R, 10G and 10B, a DC magnetic field developed from the rotation coil 10R influences a portion of the target face of the tube 14G near the coil 10R, and a DC magnetic field by the rotation coil 10B influences a portion of the target face of the tube 14G near the coil 10B. Similarly, a DC magnetic field from the rotation coil 10G influences a portion of the target face of the tube 14R near the coil 10G and a portion of the target face of the tube 14B near the coil 10G. Thus, the influences of the DC magnetic field from the rotation coils make the rotation angles different in the upper portion and the lower portion of the respective image pickup tubes at the time of the correction of the scanning area rotation by the rotation coils of the image pickup tubes. Additionally, the drive currents of the rotation coils 10R, 10G and 10B include a weak noise and the noise by various electromagnetic waves induced in the lead wires of the rotation coils. Those noises induced in the output currents of the targets have an adverse influence on a picture, frequently leading to the deterioration of a picture quality.

SUMMARY OF THE INVENTION

Accordingly, an object of the invention is to provide a scanning-area rotation device for an image pickup tube capable of making electrically a fine adjustment of the inclination of a raster on the target face without off-focusing of electron beams, and which does not induce noise into the target output signal of the image pickup tube.

To achieve the above object of the invention, there is provided a scanning-area rotation device for an image pickup tube comprising: an image pickup tube; first means for providing a static magnetic field to a target face of the image pickup tube in order to rotate a scanning-area by electron beams on the target surface, the first means being disposed near the outer periphery of the target; and second means for electrostatically shielding the first means from the target.

With such a construction, an electrostatic coupling between the first means or rotation coil and the target of the image pickup tube is considerably reduced by the second means. Accordingly, little noise is induced from the rotation coil into the target. This implies that the rotation coil may be disposed very close to the target. As a result, the intensity of the static magnetic field required to achieve a given rotation the scanning-area of the electron beam is reduced. Thus, the DC current supplied to the rotation coil may be reduced. This allows the size of the rotation coil to be made smaller. As described above, the rotation coil may be disposed close to the target and the rotation coil may be reduced in size, with the result that the image pickup tube may readily be made smaller in size than would be possible without the present invention.

Other objects and features of the invention will be apparent from the following description taken in connection with the accompanying drawings, in which:

DESCRIPTION OF THE PREFERRED EMBODIMENTS

Before explaining the invention in detail, it is to be understood that the phraseology and terminology employed herein is for the purpose of description and illustration only, and not for the purpose of limitation. Furthermore, throughout the drawings, like reference symbols are used to designate like or equivalent parts or portions for the purpose of simplicity. Specifically, those parts or portions designated by like symbols among preferred embodiments may be substituted for one another without modification or with only slight modification.

Figure 3:
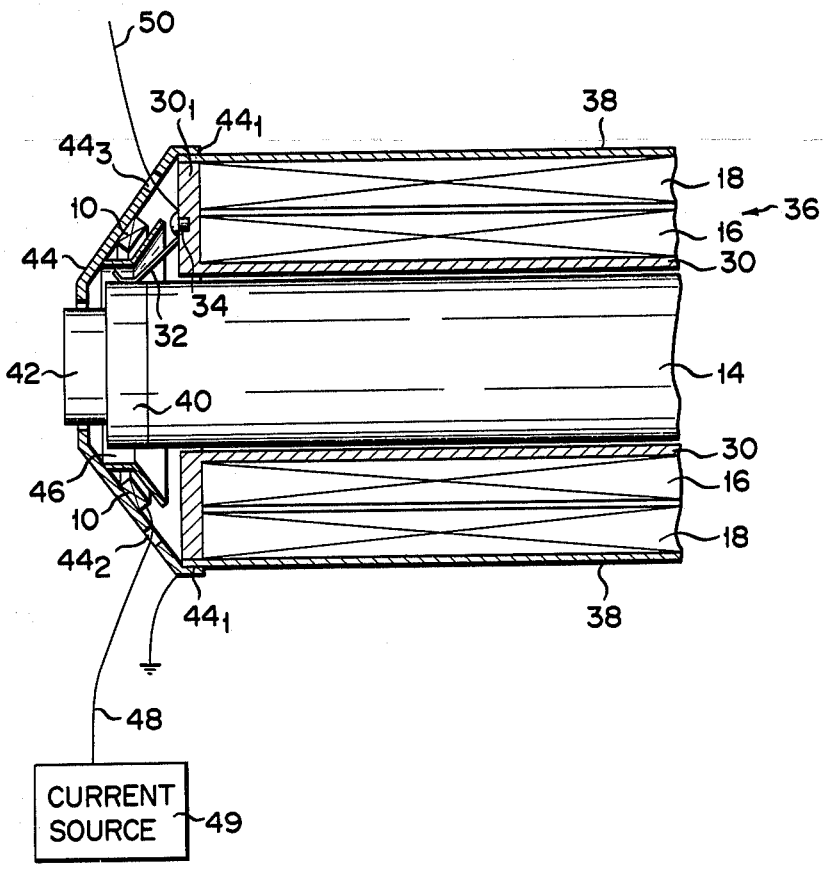
FIG. 3 shows a partial longitudinal image pickup tube which is a preferred embodiment of a scanning-area rotating device according to the invention.

FIG. 3 shows an image pickup tube for a monochrome camera or any one of a R, G or B tube for a color camera. A deflection coil 16 or a focus coil 18 are wound around a deflection coil bobbin 30. A target contact piece 32 is screwed at a proper location by a screw 34 into one end $30_1$ of the bobbin 30. A coil assembly 36 thus assembled is accommodated in a case 38. The assembly 36 is mounted to an image pickup tube 14 so that the contact piece 32 is pressed against a metal target ring 40 of the pickup tube 14. The ring 40 is electrically connected to an in-tube target of the image pickup tube 14. A flare preventive chip 42 is mounted on the upper portion of the target surface of the image pickup tube 14.

Mounted to the one end $30_1$ of bobbin 30, a shield cover 44 shaped like a cup is formed by press-moulding a Permalloy plate. The inner peripheral edge $44_1$ of the cover 44 is fitted around the outer peripheral edge of the end of the case 38. The bottom surface of the cover 44 is open through which the chip 42 partially passes. A rotation coil 10 is mounted on the inner slanted surface of the cover 44 at given location, i.e. a location allowing the coil 10 to be disposed coaxially with the image pickup tube 14.

Figure 3A:
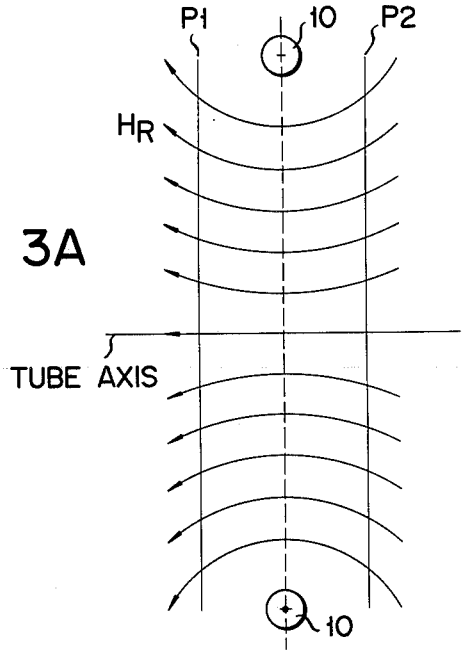
FIG. 3A shows a distribution of a magnetic field developed by a rotation coil 10.

The coil 10 developes a rotation magnetic field $H_R$ distributed as shown in FIG. 3A. At the tube axis, the direction of the magnetic field $H_R$ is the same as that of the tube axis and the divergence of the magnetic field $H_R$ is minimum. As the magnetic field $H_R$ goes away from the tube axis the divergence of $H_R$ becomes gradually large. If the target surface is disposed at a position P1 or P2, for example, in such divergent magnetic field $H_R$, the scanning-area on the target surface may be rotated.

Referring again to FIG. 3, a lead wire 48 for feeding DC current to the coil 10 is led to the exterior of cover 44 through a hole $44_2$, and is connected to a current source 49. Between the coil 10 and the target ring 40 is disposed a shield ring 46 made of non-ferromagnetic metal, for example, aluminum. The ring 46 is connected directly or through the cover 44 to a circuit having a zero AC impedance. The ring 46 is not in contact with the contact piece 32 and the ring 40. The ring 40 is connected to a preamplifier/video amplifier (not shown), through the screw 34 and an output lead wire 50. The signal line 50, which is a shielded wire, is taken out to the outside of the cover 44, through a hole $44_3$ formed in the cover 44.

Figure 1:
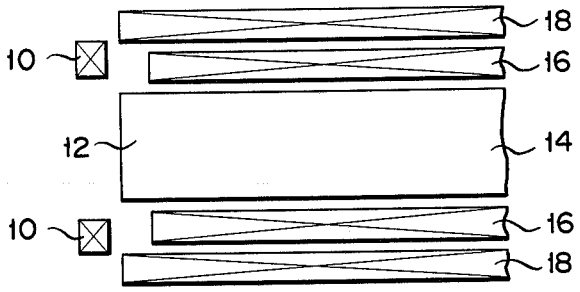
FIG. 1 shows a schematic representation of a part of an image pickup tube for electrically rotating a scanning-area on the target of an image pickup tube.
Figure 2:
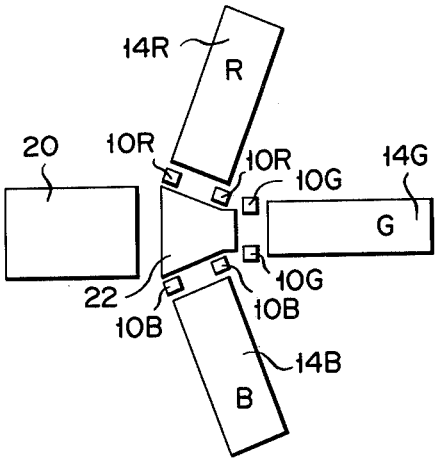
FIG. 2 shows a schematic representation obtained when the system for electrically rotating the scanning-area is applied to a three-tube type color camera.

The rotation coil 10, the shield cover 44 and the shield ring 46 cooperatively form a major portion of the scanning-area rotation device according to the invention. Specifically, the cover 44 prevents a magnetic flux emanating from the rotation coil attached to another image pickup tube (not shown) from entering the target of the image pickup tube 14. The cover 44 considerably reduces leakage of the magnetic flux from the coil 10 to exterior. Therefore, if a plurality of the image pickup tubes are closely disposed one another, as shown in FIG. 2, the registration adjustments of image pickup tubes are not influenced one another.

Additionally, the shield ring 46, i.e. an electrostatic shield member, is disposed between the coil 10 and the target. Little dielectric flux including noise developed from the coil 10 enters the target. Therefore, the coil 10 does not substantially deteriorate the S/N of the video output signal from the target. The coil 10 may accordingly be disposed as close to the target as the structure permits, leading to the minimization of the size of the scanning-area rotation device. Furthermore, the DC current supplied to the coil 10 may also be reduced.

Figure 4:
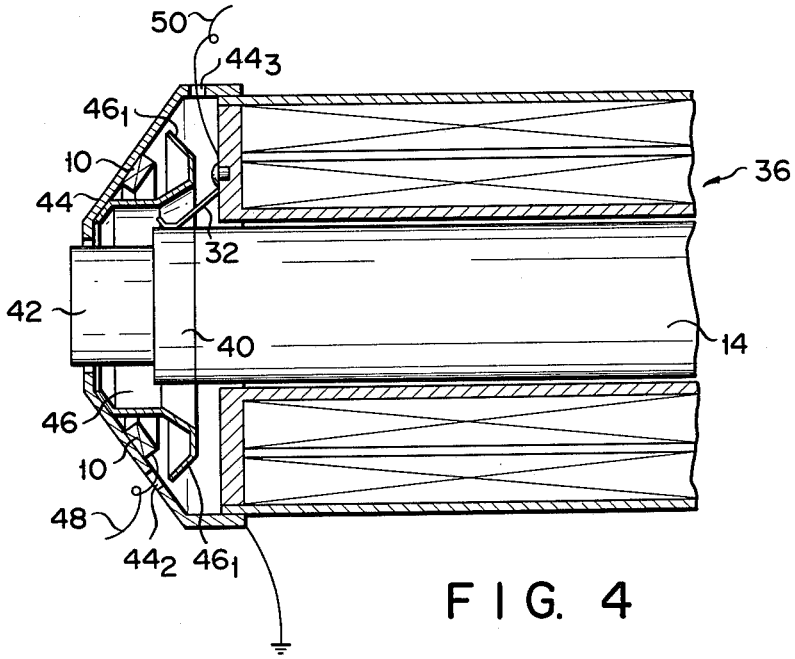
FIGS. 4 and 5 show modifications of the embodiment shown in FIG. 3.

FIG. 4 shows a modification of the embodiment shown in FIG. 3. The FIG. 4 arrangement is different from the FIG. 3 arrangement in the relative location of the rotation coil 10 to the image pickup tube 14 and the structure of the shield ring 46. More particularly, the coil 10 is further separated from the target face, compared to the case of FIG. 3. Like this case, when the coil 10 is slightly apart from the target, the magnitude of the static magnetic field for raster rotation is small. In spite of this, the object of the invention may be achieved. The ring 46 is provided with a bend portion $46_1$. The provision of the bend portion $46_1$ more completely eliminates an electrostatic coupling between the coil 10 and the target signal circuit.

Figure 5:
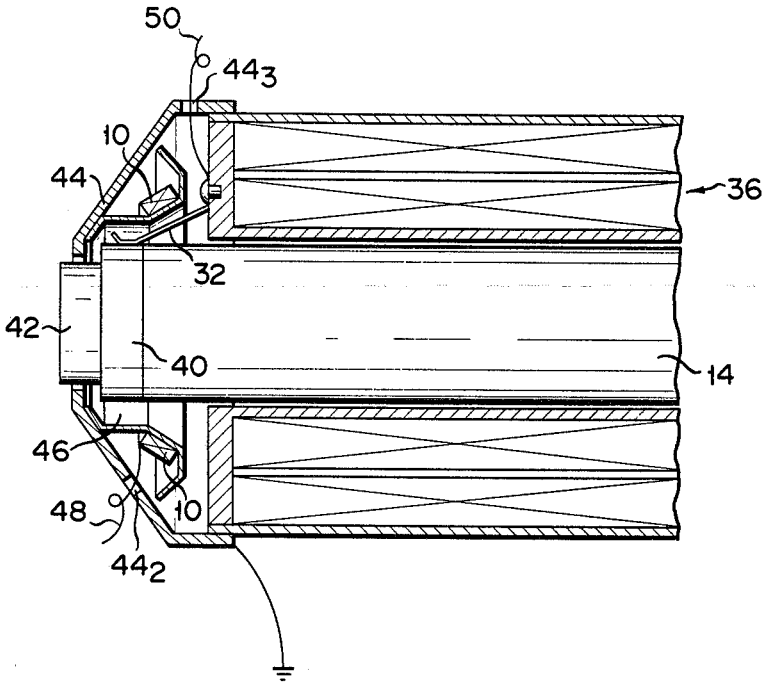

Turning now to FIG. 5, there is shown a modification of the embodiments of FIG. 3 or FIG. 4. In FIG. 5, the rotation coil 10 is mounted to the shield ring 46 side and is disposed on the rear side of the target. Such an arrangement may also achieve the object of the invention.

Figure 6:
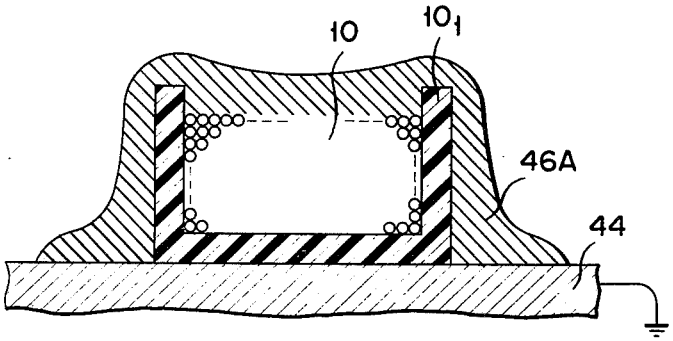
FIG. 6 shows a schematic representation of the structure for effecting electrostatic shield of the rotation coil 10.

FIG. 6 shows another embodiment which employs a conductive paint 46A in place of the shield ring 46 shown in FIGS. 3 to 5. The rotation coil 10 is wound around a coil bottin $10_1$. A wire of the coil 10 is coated with polyurethane or enamel. After the bobbin $10_1$ is attached to the shield cover 44, the coil 10 is entirely coated with the paint 46A which is conductive but not ferromagnetic. Further, the paint 46A is grounded through the cover 44 so that it is electrostatically shielded.

Although specific construction have been illustrated and described herein, it is not intended that the invention be limited to the elements and constructions disclosed. One skilled in the art will recognize that the particular elements or sub-constructions may be used without departing from the scope and spirit of the invention.

What we claim is:

1. A scanning-area rotation device for an image pickup tube comprising:

an image pickup tube having a target including a target face first means, positioned near the outer periphery of the target, for providing a static magnetic field to said target face in order to rotate a scanning-area thereof by electron beams on said target face; and second means for electrostatically and not magnetically shielding said first means from the target.

2. A scanning-area rotation device for an image pickup tube comprising:

an image pickup tube having a target including a target face;

first means positioned near the outer periphery of the target, for providing a static magnetic field to said face in order to rotate a scanning-area thereof by electron beams on said target face;

second means for electrostatically and not magnetically shielding said first means from the target and a signal path connecting to the target; and means for electromagnetically shielding said first means and the target from the exterior of said image pickup tube.

3. A scanning-area rotation device for an image pickup tube according to claim 1 or 2, wherein said second means is a non-ferromagnetic, conductive member connecting to a circuit with zero of AC potential.

4. A scanning-area rotation device for an image pickup tube according to claim 1 or 2, wherein said first means is a rotation coil for developing a static magnetic field by DC current; and said second means is a non-ferromagnetic, conductive member for covering a block of the rotation coil, said conductive member connecting to a circuit having a zero AC impedance.

5. A scanning area rotation device according to claim 1 or 2 wherein said first means is positioned with respect to said target of said image pickup tube such that the target will be at a position whereat the static magnetic field of said first means has a divergence greater than a predetermined amount.

6. A scanning area rotation device according to claim 3 wherein said first means is positioned with respect to said target of said image pickup tube such that the target will be at a position whereat the static magnetic field of said first means has a divergence greater than a predetermined amount.

7. A scanning area rotation device according to claim 4 wherein said first means is positioned with respect to said target of said image pickup tube such that the target will be at a position whereat the static magnetic field of said first means has a divergence greater than a predetermined amount.

* * * * *